United States Patent [19]

Noguchi et al.

[11] 4,180,039

[45] Dec. 25, 1979

[54] FUEL INJECTION SYSTEM FOR AN INTERNAL COMBUSTION ENGINE

[75] Inventors: Masaaki Noguchi, Nagoya; Yukiyasu Tanaka, Okazaki; Taro Tanaka, Chiryu, all of Japan

[73] Assignee: Nippon Soken, Inc., Nishio, Japan

[21] Appl. No.: 903,658

[22] Filed: May 8, 1978

[30] Foreign Application Priority Data

May 12, 1977 [JP] Japan ..... 52-54686

[51] Int. Cl.[2] ..... F02M 39/00

[52] U.S. Cl. ..... 123/139 AW; 123/139 BD; 123/32 F; 123/139 BC

[58] Field of Search ..... 123/139 BC, 139 BD, 123/139 BE, 139 AW, 139 AB, 30 B, 32 F, 32 G

[56] References Cited

U.S. PATENT DOCUMENTS

| | | | |
|---|---|---|---|
| 3,996,910 | 12/1976 | Noguchi et al. | 123/139 BC |
| 4,046,122 | 9/1977 | Nakagawa et al. | 123/139 AW |

FOREIGN PATENT DOCUMENTS

| | | | |
|---|---|---|---|
| 666491 | 9/1938 | Fed. Rep. of Germany | 123/139 BC |
| 1010566 | 6/1952 | France | 123/139 BC |
| 734279 | 7/1955 | United Kingdom | 123/139 BC |

*Primary Examiner*—Charles J. Myhre
*Assistant Examiner*—M. Moy
*Attorney, Agent, or Firm*—Cushman, Darby & Cushman

[57] ABSTRACT

A fuel injection system for an internal combustion engine has two sets of fuel injectors mounted on the engine so that each engine cylinder is provided with two injectors. A fuel metering and distributing device meters a fuel under pressure from a fuel source and distributes the metered fuel to respective injectors. The fuel metering and distributing device includes a housing provided with a fuel inlet connected to the fuel source and two sets of fuel outlet ports each connected to one of the fuel injectors. A rotor is mounted in the housing for rotation in timed relationship to the engine operation and is provided with an axial fuel passage always in communication with the fuel inlet. Two orifices are formed in the peripheral wall of the rotor in communication with the fuel passage while two sets of apertures each communicated with one of the fuel outlet ports are formed either in the housing or in a control shaft disposed in the housing in telescopic relationship to the rotor. The rotation of the rotor brings at least one of the orifices therein into overlapping and communicating relationship to successive apertures of the corresponding set so that the fuel flows from the fuel passage through the overlapped and communicated orifice and apertures to the associated fuel outlet ports and thus to the associated fuel injectors. Relative movement between two orifices and two sets of apertures axially of the rotor is caused when the rate of engine intake air flow is varied. The arrangement is such that, when the rate of the intake air flow is within a first range smaller than a predetermined rate, only one of the orifices is brought into overlapping and communicating relationship to successive apertures of the associated set and such that, when the intake air flow rate is within a second range greater than the predetermined rate, both orifices are brought into overlapping and communicating relationship to successive apertures of the two sets, respectively, whereby fuel supply to respective engine cylinders is increased when the intake air flow rate is increased beyond the predetermined rate.

7 Claims, 5 Drawing Figures

FUEL INJECTION SYSTEM FOR AN INTERNAL COMBUSTION ENGINE

CROSS REFERENCE TO RELATED APPLICATIONS

This application is generally related to our copending applications Ser. Nos. 881,846 and 893,533 filed Feb. 27, 1978 and Apr. 4, 1978, respectively, and both titled "a fuel injection system for an internal combustion engine". All the disclosure in the copending earlier applications is incorporated herein by reference.

BACKGROUND OF THE INVENTION

1. Field of the Invention

The present invention relates to a fuel injection system for a spark-ignition internal combustion engine which is operative to mechanically meter a liquid fuel and intermittently inject the metered fuel into the engine.

2. Description of the Prior Art

Systems of various types and structures have been proposed for injecting a fuel such as gasoline into internal combustion engines. The known types of fuel injection systems include an intermittent fuel injection type that includes a rotor with a single orifice formed therein. The rotor is rotated to meter and distribute the fuel to a series of fuel injectors provided for respective engine cylinders.

With the intermittent fuel injection system of the type specified above, a difficulty is encountered that, because of the single orifice formed in the rotor, a prolonged period of time is required for the injection of an amount of fuel through an injector with a result that the fuel cannot be injected within a short period of time in an appropriate stroke of the engine. This difficulty could be overcome by use of a large-sized orifice. With a large-sized orifice, however, the flow of fuel through the orifice per unit of time is increased with a resultant increase of the resistance of each injector to the flow of fuel therethrough. The use of a large-sized orifice, moreover, would cause an adverse effect to uniform fuel supply to respective engine cylinders, because of the unequal pressures in the fuel delivery lines downstream of the orifice which would be caused by different flow characteristics of respective fuel injections.

U.S. Pat. No. 3,996,910 issued Dec. 14, 1976 to Masaaki Noguchi et al. (inventors of the present application) discloses a fuel injection system comprising a fuel metering and distributing device which includes a rotor and a control shaft. Fuel metering and distributing slits or orifices are formed in the control shaft and in the rotor. The orifice in the rotor is brought into overlapping relationship with successive orifices in the control shaft by the rotation of the rotor to meter and distribute the fuel to respective fuel injectors. The area over which the orifice in the rotor is overlapped with each of the orifices in the control shaft is varied in accordance with a variation in an engine operating parameter, such as the rate of engine intake air flow, to control the rate of fuel flow through the overlapped fuel metering and distributing orifices. The angle of rotation of the rotor relative to the control shaft over which angle the orifice in the rotor is communicated with each of the orifices in the control shaft is constant regardless of the rate of engine intake air flow. The fuel injection system of the described structure and arrangement is difficult to manufacture and to satisfy the requirement for the fuel metering accuracy.

SUMMARY OF THE INVENTION

It is an object of the present invention to provide an improved fuel injection system which eliminates the prior art difficulties discussed above.

It is another object of the present invention to provide an improved fuel injection system which is simple in structure and easy to manufacture.

It is a further object of the present invention to provide an improved fuel injection system which comprises a plurality of sets of fuel delivery circuits including fuel injectors arranged such that each engine cylinder is provided with a plurality of injectors and in which the number of the sets of fuel delivery circuits through which the fuel is supplied to the engine cylinders is increased as the engine intake air flow rate is increased, and vice versa.

According to the present invention, there is provided a fuel injection system for an internal combustion engine, which comprises:

a plurality of sets of fuel injectors adapted to be mounted on the engine;

each of the fuel injectors of each set being associated with one of the engine cylinders so that each engine cylinder is provided with a plurality of injectors equal in number to the fuel injector sets;

a fuel source operative to supply a fuel under a predetermined pressure to said fuel injectors;

means for metering the fuel from said fuel source and distributing the metered fuel to said fuel injectors;

said fuel metering and distributing means including a housing defining therein a fuel inlet port connected to said fuel source and a plurality of sets of fuel outlet ports each connected to one of said fuel injectors;

the fuel outlet port sets being equal in number to said fuel injector sets;

said fuel metering and distributing means further including a rotor and means defining a plurality of sets of apertures;

the apertures of each set being equal in number to the engine cylinders;

the aperture sets being equal in number to said fuel outlet sets and thus to said fuel injector sets;

said rotor being mounted in said housing for rotation in timed relationship to the engine operation and defining a plurality of orifices equal in number to said aperture sets and operatively associated respectively with said aperture sets;

one of said rotor and said aperture defining means being disposed inside the other and defining a fuel passage always in communication with said fuel inlet port in said housing;

each of said apertures being substantially aligned with one of said fuel outlet ports;

the rotation of said rotor moving said orifices relative to said apertures in the circumferential direction of said rotor so that at least one of said orifices is brought into overlapping and communicating relationship with successive apertures of the corresponding set to allow the fuel to flow from said fuel passage through the overlapped and communicated orifice and apertures to the associated fuel outlet ports and thus to the associated fuel injectors;

means responsive to variation in the rate of engine intake air flow to cause relative movement between said aperture defining means and said rotor so that relative movement between said rotor and said sets of apertures is caused axially of said rotor, the arrangement being such that the number of the orifices brought into overlapping and communicating relationship to the apertures is increased to increase the fuel supply to respective engine cylinders as the engine intake air flow rate is increased, and vice versa.

The aperture defining means may comprise a cylindrical hollow control shaft disposed in the housing in telescopic relationship to the rotor and axially movable relative to the rotor by the intake air flow rate responsive means. Alternatively, the apertures may be formed in the housing in communication with the fuel outlet ports, respectively. In the alternative case, the rotor may comprise a first and second parts. The first rotor part may be driven by the engine, while the second rotor part may be coupled to the first rotor part such that the second part is rotated by the first part and axially movable relative to the first part by the intake air flow rate responsive means. The orifices may be formed in the second part.

In either case, the rotor may be provided with first and second orifices. The arrangement may advantageously be such that, when the rate of the intake air flow is within a first range smaller than a predetermined rate, the first orifice only is moved by the rotation of the rotor into overlapping and communicating relationship to successive apertures of the associated set and such that, when the intake air flow rate is within a second rate greater than the predetermined rate, the first and second orifices are both moved into overlapping and communicating relationship to successive apertures of the associated sets, respectively.

The above and other objects, features and advantages of the present invention will be made more apparent by the following description with reference to the accompanying drawings.

DESCRIPTION OF PREFERRED EMBODIMENTS

Figure 1:
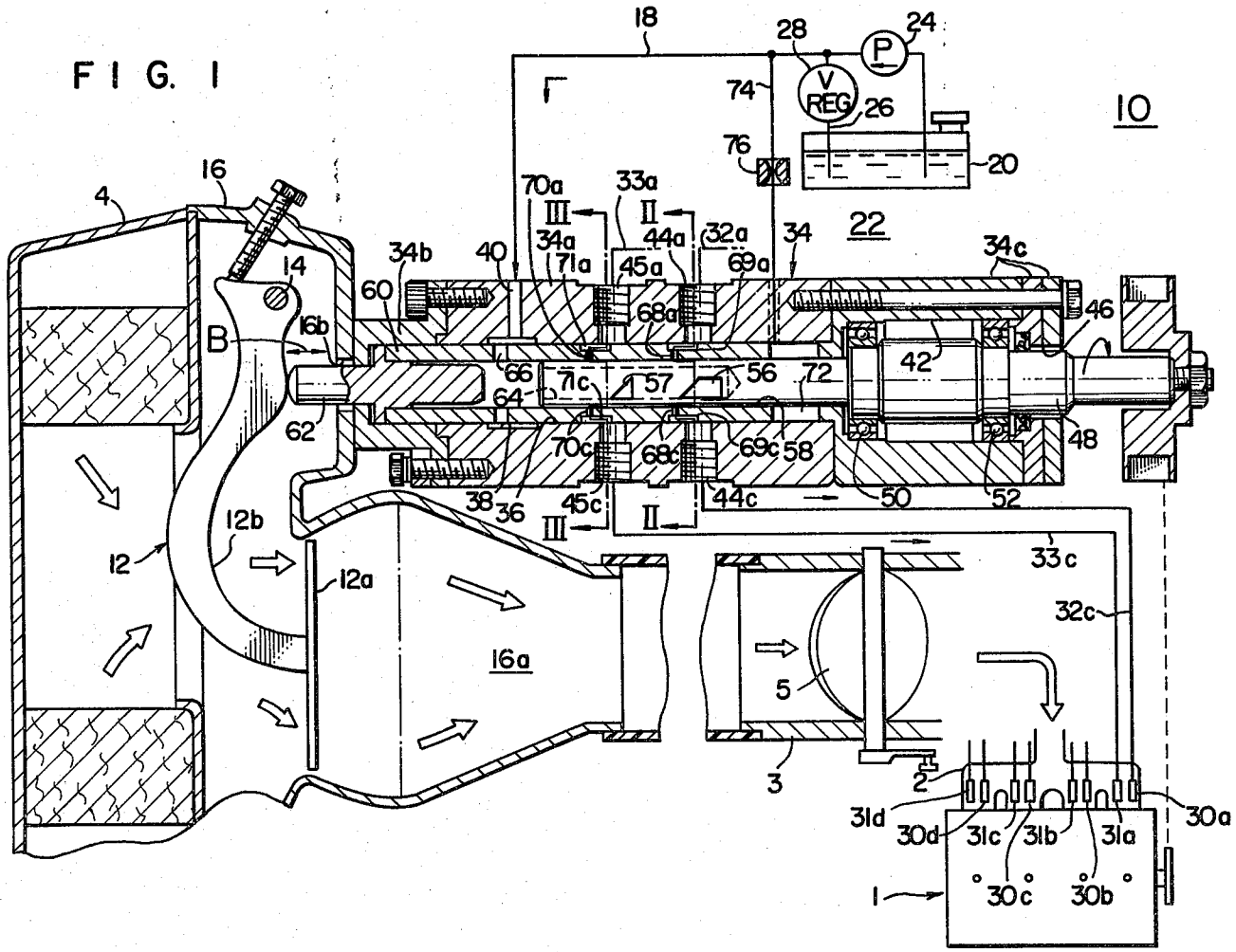
FIG. 1 is a partly sectional diagrammatic illustration of an embodiment of a fuel injection system for an internal combustion engine according to the present invention.
Figure 2:
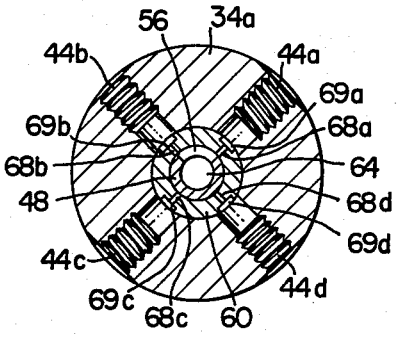
FIGS. 2 and 3 are cross-sectional views of a fuel metering and distributing device as taken on lines II—II and III—III in FIG. 1, respectively.
Figure 3:
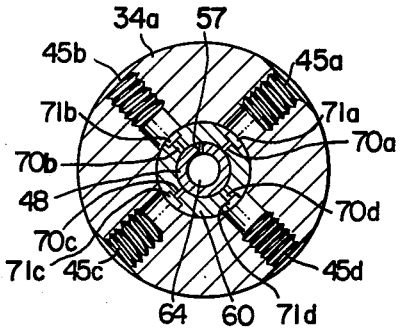

Referring first to FIGS. 1 to 3 of the drawings, a conventional 4-stroke, reciprocal piston, spark-ignition internal combustion engine 1 is shown as having 4 cylinders and an intake manifold 2 and an intake air duct 3 upstream thereof. Air from a conventional air cleaner 4 flows through the intake air duct 3 and intake manifold 2 into respective engine cylinders. The air flow is controlled by a throttle valve 5 pivotally mounted in the intake air duct 3 and operated in conventional manner by an engine accelerator (not shown).

A fuel injection system generally designated by 10 includes an air flow sensor 12 disposed between the air intake duct 3 and the air cleaner 4 to detect the rate of air flow from the cleaner through the duct 3 and manifold 2 into the engine 1. The sensor 12 comprises a vane **12*a* disposed in the path of the air flow and connected to an end of a lever 12*b* which is pivotally mounted by a pin 14 in an enclosure 16 which is connected to the air cleaner 4 and which defines therein an air passage 16*a* upstream of the air duct 3. It will be noted that the lever 12*b* and the vane 12*a* carried thereby are rotated in counterclockwise direction about the pin 14 as the rate of air flow through the air passage 16*a* into the engine 1** is increased.

The fuel supply circuit of the fuel injection system 10 includes a fuel supply line 18 extending between a fuel tank 20 and a fuel delivery device or distributor 22 to be described later. An electrically actuated fuel pump 24 is provided in the fuel supply line 18 to pump the fuel from the tank 20 into the distributor 22. A fuel return line 26 is provided between the fuel tank 20 and the fuel supply line 18 downstream of the pump 24. A pressure regulator 28 is provided in the return line 26 and uses either the atmospheric pressure or the engine intake manifold vacuum as a reference pressure to release surplus fuel from the supply line 18 through the return line 26 back into the tank 20 so that the fuel in the supply line 18 is kept at a substantially fixed constant pressure (2 to 10 atm).

The fuel injection system 10 includes first and second series or sets of fuel injectors **30*a* to 30*d* and 31*a* to 31*d*. Each of the two series of injectors is mounted on one of the four branches of the engine intake manifold 2. Thus, each intake manifold branch is provided with two injectors as shown in FIG. 1. Fuel injectors 30*a* to 30*d* and 31*a* to 31*d*** are operative in response to fuel supply at more than a predetermined pressure to automatically inject the fuel into associated intake manifold branches.

The distributor 22 is operative to meter and distribute the fuel from the fuel supply 18 to the fuel injectors **30*a* to 30*d* and 31*a* to 31*d* through two independent series of fuel delivery lines, only two lines of each series being shown in FIG. 1 by reference numerals 32*a* and 32*c* and 33*a* and 33*c***, respectively.

The distributor 22 comprises a generally cylindrical housing 34 rigidly mounted on the enclosure 16. The housing 34 includes a generally cylindrical hollow main part **34*a* bolted at one end to a left end part 34*b* secured to the enclosure 16 and a right end part 34*c* secured to the main part 34*a* by bolts to complete the housing 34. The main part 34*a* of the housing 34 defines therein a generally cylindrical axial bore 36 having an inner peripheral surface in which an annular groove 38 is formed. A single fuel inlet port 40 connected to the fuel supply line 18 extends radially through the wall of the housing part 34*a* to the annular groove 38. The right end housing part 34*c* defines therein a generally cylindrical bore 42 extending in coaxial relationship with the axial bore 36 in the main housing part 34*a***.

As will be best seen in FIG. 2, a first circumferential row of four fuel outlet ports **44*a* to 44*d* is provided in the peripheral wall of the housing part 34*a*. These ports are arranged at intervals of 90 degrees, respectively, and connected respectively to the fuel injectors 30*a* to 30*d* through the fuel delivery lines one of which is shown by 32*c*. A second circumferential row of four fuel outlet ports 45*a* to 45*d* is also provided in the peripheral wall of the housing part 34*a* in axially spaced relationship to the first row of the fuel outlet ports 44*a* to 44*d*. The fuel outlet ports 45*a* to 45*d* of the second row are also arranged at intervals of 90 degrees, as best seen in FIG. 3, axially aligned respectively with the ports 44***a* to 44*d* of the first row and connected respectively to the fuel injectors 31*a* to 31*d* through the fuel delivery lines one of which is shown by 33*c*.

An axially elongated rotor 48 is rotatably mounted in the bore 42 in the housing end part 34*c* by a pair of axially spaced bearings 50 and 52 and has an end projecting through an opening 46 in the right end of the housing part 34*c*. This projecting end of the rotor 48 is adapted to be connected to a circular rotary member which, in the illustrated embodiment, is in the form of a pulley drivingly connected by an endless belt to the output shaft of the engine 1 so that the rotor 48 is driven in timed relationship with the engine rotation. The arrangement is such that the rotor 48 is driven one revolution while the engine crank shaft (not shown) is rotated two revolutions. The left end portion of the rotor 48 defines therein an axial fuel passage 64 open in the left end face of the rotor 48. A pair of axially aligned and spaced orifices in the form of trapezoid and triangular openings 56 and 57 are formed in and radially extend through the peripheral wall of the rotor 48 to the axial fuel passage 64.

A cylindrical control shaft 60 is axially slidably received in the axial bore 36 in the main housing part 34*a* and has a hollow right end portion defining therein an axial bore 58 in which the left end portion of the rotor 48 is received for rotation relative to the shaft 60. The control shaft 60 is supported so as not to be rotated by the rotation of the rotor 48 but axially movable relative to the rotor 48. The control shaft 60 is connected at its left end to a plunger 62 which slidably extends out of the bore 36 and through an opening 16*b* in the enclosure 16 into slidable engagement with the lever 12*b* of the air flow sensor 12 so that, when the lever 12*b* is rotated counterclockwise by the increase in the engine intake air flow rate, the plunger 62 is pushed rightwards to move the control shaft 60 axially rightwards. The fuel passage 64 in the rotor 48 is always in communication with the annular groove 38 through the bore 58 and through fuel inlets 66 formed in the peripheral wall of the control shaft 60 in axial alignment with the groove 38.

The control shaft 60 is provided with a first circumferential row of four small circular apertures 68*a* to 68*d* formed at substantially equal circumferential intervals in the peripheral wall of the shaft in generally axial alignment with the orifice 56 so that the rotation of the rotor 48 moves the orifice 56 successively into overlapping and communicating relationship with the small apertures 68*a* to 68*d*. These apertures are respectively open in recesses 69*a* to 69*d* which are formed in the outer peripheral surface of the control shaft 60 and substantially radially and generally axially aligned with the fuel outlet ports 44*a* to 44*d*, respectively. The control shaft 60 is further provided with a second circumferential row of four small circular apertures 70*a* to 70*d* formed at substantially equal circumferential intervals in the peripheral wall of the shaft and in axially aligned relationship to the apertures 68*a* to 68*d* of the first row, respectively. The second row of apertures 70*a* to 70*d* is disposed in axially slightly offset relationship with the second orifice 57 in the rotor 48 for the purpose to be described later. The apertures 70*a* to 70*d* are respectively open in recesses 71*a* to 71*d* which are formed in the outer peripheral surface of the control shaft 60 and substantially radially and generally axially aligned with the fuel outlet ports 45*a* to 45*d*, respectively.

The trapezoid and triangular orifices 56 and 57 in the rotor 48 and the first and second rows of the small circular apertures 68*a* to 68*d* and 70*a* to 70*d* in the control shaft 60 are arranged such that the trapezoid orifice 56 is moved by the rotation of the rotor 48 into overlapping and communicating relationship to successive small circular apertures 68*a* to 68*d* of the first row and such that, after the engine intake air flow is increased beyond a predetermined rate and the control shaft 60 is rightwardly moved relative to the rotor 48 beyond a predetermined position relative to the rotor, the triangular orifice 57 is moved by the rotation of the rotor 48 into overlapping and communicating relationship to successive small circular apertures 70*a* to 70*d* of the second row. The distance or angle of rotation of the rotor over which each of the small circular apertures 68*a* to 68*d* of the first row is kept overlapped and communicated with the trapezoid orifice 56 during one revolution of the rotor 48 and the distance or angle of rotation of the rotor over which each of the small circular apertures 70*a* to 70*d* of the second row is kept overlapped and communicated with the triangular orifice 57 during one revolution of the rotor 48 (said angle will be termed "communication-lasting angle" hereinafter) are both controlled by the axial movement of the control shaft 60 relative to the rotor 48 which is caused by the increase or decrease of the rate of the engine intake air flow. The orifices 56 and 57 and the apertures 68*a* to 68*d* and 70*a* to 70*d* are also arranged such that the angle of rotation of the rotor over which each of the small apertures 68*a* to 68*d* of the first row is kept overlapped and communicated with the trapezoid orifice 56 becomes constant after the control shaft 60 is moved to the position in which the triangular orifice 57 is rotated into overlapping and communicating relationship to successive small apertures 70*a* to 70*d* of the second row. The angle over which each of the small apertures of the second row is kept overlapped and communicated with the triangular orifice 57 is varied, as mentioned above.

The above will be described in more detail with reference to FIG. 4 which illustrates in schematic development view the cooperation of the orifices 56 and 57 and the apertures 68*a* to 68*d* and 70*a* to 70*d* to meter and distribute the fuel. It will be noted that, because each of the small circular apertures 68*a* to 68*d* of the first row is smaller than the associated trapezoid orifice 56, the area over which each of the small apertures of the first row is communicated with the trapezoid orifice 56 is determined by the cross-sectional area of each small aperture and thus is substantially constant. For a similar reason, the area over which each of the small circular aperture 70*a* to 70*d* of the second row is communicated with the triangular orifice 57 is determined by the cross-sectional area of each of the small apertures of the second row and thus is substantially constant. When the engine intake air flow is at a rate smaller than the predetermined rate, the first and second rows of the small circular apertures 68*a* to 68*d* and 70*a* to 70*d* are located in the positions shown by solid lines relative to the trapezoid and triangular orifices 56 and 57, respectively. Thus, the rotation of the rotor 48 as indicated by arrows A brings the small apertures 68*a* to 68*d* of the first row only into overlapping and communicating relationship to the trapezoid orifice 56. The "communication-lasting angle" is indicated by "a" which is variable by the axial movement of the control shaft 60 relative to the rotor 48, as indicated by arrows B in FIGS. 1 and 4. When the engine intake air flow is increased beyond the predetermined rate with resultant axial displacement of the first and second rows of the small circular apertures 68*a* to 68*d* and 70*a* to 70*d* to the positions shown by broken lines in FIG. 4, the "communication-lasting angle" of the first row of small apertures 68*a* to 68*d* relative to the trapezoid orifice 56 is increased to "b" and simultaneously the small circular apertures 70*a* to 70*d* of the second row are caused to communicate with the triangular orifice 57 over a "communication-lasting angle" of "c" which is variable with the axial movement of the control shaft 60 relative to the rotor 48. Because each of the four small apertures 68*a* to 68*d* of the first row and each of the four small apertures 70*a* to 70*d* of the second row are communicated with the fuel injectors associated with one of the four engine cylinders, the "communication-lasting angles" over which the communication between the trapezoid and triangular orifices 56 and 57 and the first and second rows of small circular apertures will be equivalent to the total of "b" and "c". Because the trapezoid and triangular orifices 56 and 57 in the rotor 48 are moved in the direction indicated by the arrows A relative to the small circular apertures 68*a* to 68*d* and 70*a* to 70*d*, respectively, the times when the trapezoid and triangular orifices 56 and 57 commence their communication with respective small circular apertures of the first and second rows are varied by the relative movements of the small apertures with respect to the trapezoid and triangular orifices in the direction indicated by the arrows B. The times of commencement of the communication between the trapezoid orifice and small circular apertures of the first row and between the triangular orifice and small circular apertures of the second row are advanced as the rate of engine intake air flow is increased, and vice versa. On the other hand, the times when the communications between the trapezoid orifice and small circular apertures of the first row and between the triangular orifice and the small circular apertures of the second row are finished are constant regardless of the axial movements of the first and second rows of small circular apertures relative to the trapezoid and trangular orifices.

A chamber 72 is defined in the axial bore 36 between the right end of the control shaft 60 and the left end of the right end housing part 34*c*. Fuel under pressure is introduced into the chamber 72 through a fuel pressure line 74, in which a fixed restriction 76 is provided, to hydraulically exert a return or leftward force to the control shaft 60.

In operation, the liquid fuel pumped up from the tank 20 into the fuel supply line 18 is kept at a substantially constant pressure by the pressure regulator 28 and enters the distributor 22 through the fuel inlet port 40 from which the fuel flows through the annular groove 38 and the fuel inlets 66 in the control shaft 60 into the axial fuel passage 64 in the rotor 48.

When the rate of engine intake air flow is less than the predetermined rate, the rotation of the rotor 48 successively brings the orifice 56 into communication with the small circular apertures 68*a* to 68*d*. For example, when the orifice 56 is moved into communication with the aperture 68*a*, the fuel will flow from a fuel passage 64 in the rotor 48 through the overlapped orifice 56 and the aperture 68*a* and through the associated recess 69*a* and the fuel outlet port 44*a*. Thus, the fuel is fed to an associated fuel injector and injected thereby into an associated branch of the engine intake manifold 2.

When the engine intake air flow is increased beyond the predetermined rate, the rotation of the rotor 48 also brings the triangular orifice 57 into communication with successive small circular apertures 70*a* to 70*d*. Thus, metered amounts of the fuel are fed through two independent fuel delivery lines to each of the four sets of the fuel injectors associated with respective engine cylinders.

The rotor 48 is rotated one revolution during two revolutions of the engine crank shaft, as discussed previously. Because the control shaft 60 is provided with four pairs of apertures 68*a* to 68*d* and 70*a* to 70*d* and because the distributor housing part 34*a* is provided with four pairs of the fuel outlet ports 44*a* to 44*d* and 45*a* to 45*d*, the distributor 22 is operative to distribute the fuel to each of the fuel outlet ports 44*a* to 45*d* and thus to the associated fuel injector one time per two revolutions of the engine crank shaft when the rate of the engine intake air flow is greater than the predetermined rate. It will be noted that the fuel is distributed to only one series of the injectors 30*a* to 30*d* when the rate of the engine intake air flow is less than the predetermined rate. With a 4-stroke engine, one cycle of engine operation consists of two crank shaft revolutions (with a 2-stroke engine, one cycle of engine operation consists of one crank shaft revolution and thus the rotor 48 will have to be rotated one revolution per each crank shaft revolution). Thus, the illustrated embodiment of the invention is operative to intermittently deliver the fuel to each of the engine intake manifold branches during an appropriate stroke of the associated engine cylinder.

Figure 4:
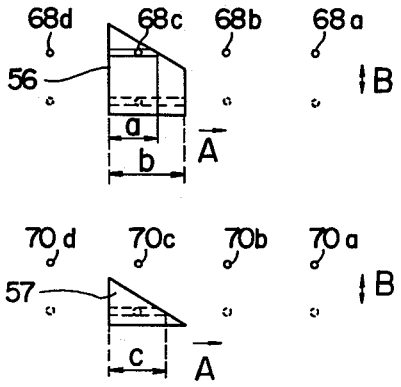
FIG. 4 illustrates, in enlarged schematic development view, fuel metering orifices and apertures in a rotor and control member shown in FIGS. 1, 2 and 3.

The fuel is metered and distributed by the cooperation of the orifices 56 and 57 and the apertures 68*a* to 68*d* and 70*a* to 70*d* in the manner shown in FIG. 4. The rotation of the rotor 48 relative to the control shaft 60 moves the orifices 56 and 57 in the direction indicated by the arrows A into overlapping and communicating relationship with successive small circular apertures 68*a* to 68*d* of the first row and 70*a* to 70*d* of the second row to meter and distribute the fuel. The control shaft 60 is axially moved relative to the rotor 48 in accordance with the variation in the engine intake air flow as detected by the air-flow second 12. When the rate of the engine intake air flow is less than the predetermined rate, the control shaft 60 is placed in a position in which only the trapezoid orifice 56 is moved into overlapping and communicating relationship to successive small circular aperture 68*a* to 68*d* of the first row and in which the communication-lasting angle over which each small circular aperture is kept communicated with the trapezoid orifice 56 during one revolution of the rotor 48 is variable with the axial movement of the control shaft 60. Because the area of overlap and communication of the trapezoid orifice 56 with each of the small circular apertures 68*a* to 68*d* is substantially constant, the amounts of fuel delivered to the first series of the fuel injectors 30*a* to 30*d* are metered according to the rate of the engine intake air flow.

When the rate of the engine intake air flow is increased beyond the predetermined rate, the control shaft 60 is rightwardly moved to a position in which the small circular apertures 68*a* to 68*d* and 70*a* and 70*d* of the first and second rows are placed in the positions shown by broken lines in FIG. 4. In this position of the control shaft 60, the communication-lasting angle of the trapezoid orifice 56 relative to each of the small circular apertures 68*a* to 68*d* of the first row is constant (as indicated by "b" in FIG. 4), while the communication-lasting angle of the triangular orifice 57 relative to each of the small circular apertures 70*a* to 70*d* of the second row is variable (as indicated by "c") with the variation of the engine intake air flow rate. It will be appreciated that the trapezoid and triangular orifices 56 and 57 are substantially simultaneously brought into communication with one of the small circular apertures 68*a* to 68*d* of the first row and with one of the small circular apertures 70*a* to 70*d* of the second row so that two injectors associated with each of the engine cylinders are simultaneously supplied with the fuel to be injected. The total areas of communications between the trapezoid orifice 56 and each of the small circular apertures 68*a* to 68*d* of the first row and between the triangular orifice 57 and each of the small circular apertures 70*a* to 70*d* of the second row are determined by the cross-sectional areas of the first and second rows of the small circular apertures and thus are substantially constant. Thus, when the engine intake air flow is greater than the predetermined rate and the small circular apertures of the first and second rows are located in the broken line positions, the supply of fuel to each engine cylinder is controlled and adjusted in accordance with the communication-lasting angle "c" which is variable with the change of the rate of the engine intake air flow within the range higher than the predetermined rate.

The described and illustrated embodiment of the invention is advantageous in that the fuel is supplied into respective engine cylinders through a first series of fuel delivery circuits including the first series of the fuel injectors 30*a* to 30*d* when the rate of the engine intake air flow is less than the predetermined rate and that the fuel is supplied to the cylinders through both of the first and second series of the fuel delivery circuits when the engine intake air flow is increased beyond the predetermined rate, the second series of circuis including the second series of the fuel injectors 31*a* to 31*d*. The fuel supply through two series of the fuel delivery circuits is advantageous in that the communication-lasting angle of the orifices in the rotor 48 relative to each of the apertures in the control shaft can be made small and that a charge of fuel to each engine cylinder can be injected within a short period of time and at an optimum timing during a selected stroke of the engine. The use of the two fuel delivery circuits provides a further advantage that the communication-lasting angle and the area of communication between each of the orifices in the rotor and each of the apertures in the control shaft can both be made small with resultant advantageous decrease in the flow of fuel through each orifice and aperture per unit of time and decrease in the resistance of each fuel injector to the flow of fuel. This makes it possible to choose a large difference in fuel pressure across each pair of associated fuel metering and distributing orifice and aperture. The fuel supply to each engine cylinder is dependent on the area of overlap and communication between each pair of associated fuel metering and distributing orifice and aperture and also on the fuel pressure difference across each pair of the orifice and aperture. The use of a large fuel pressure difference across each pair of fuel metering and distributing orifice and aperture can minimize an adverse effect, to uniform fuel supply to respective engine cylinders, of the unequal pressures in the fuel delivery lines downstream of the orifices which would be caused by different flow characteristics of respective fuel injectors. In addition, the effect, to the engine performance, of the change of the flow characteristics of injectors due to the operation of the injectors for a prolonged time and to the formation of deposits in the injectors is minimized. Moreover, the reduction of the rate of fuel flow through the metering orifice and apertures enables the injector nozzle orifices to be small-sized to advantageously eliminate a possibility that a part of each fuel charge is left with the injector at the final stage of each injection operation and flows out of the injector in the form of a drop or drops.

In the described and illustrated embodiment of the invention, the rotor 48 extends into the control shaft 60. The rotor, however, may alternatively extend over the control shaft 60.

The trapezoid and triangular orifices 56 and 57 and the small circular apertures 68*a* to 68*d* and 70*a* to 70*d* may alternatively be in the forms of slits extending obliquely relative to the common axis of the rotor and the control shaft as disclosed in our copending earlier application Ser. No. 881,846 referred to previously.

As a further modification, the small circular aperture 68*a* to 68*d* and 70*a* to 70*d* may be substituted by triangular orifices, as disclosed in our second copending earlier application Ser. No. 893,533 referred to previously and, at the same time, the fuel outlet ports 44*a* to 45*a* may be provided with fixed restriction orifices providing fuel flow sectional areas smaller than the areas of overlap between th trapezoid and triangular orifices 56 and 57 in the rotor 48 and the substitution triangular orifices in the control shaft, as also disclosed in the second copending earlier application.

Figure 5:
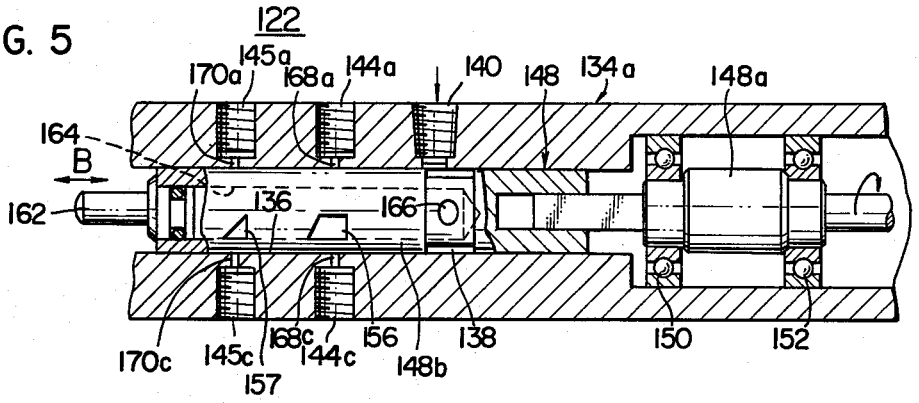
FIG. 5 is a partly sectional view of a fuel metering and distributing device of a second embodiment of the invention.

A second embodiment of the invention is illustrated in FIG. 5 in which parts similar to those of the first embodiment are designated by similar reference numerals added by one hundred. The embodiment includes a fuel distributor 122 which does not include a control shaft but has a distributor housing part 134*a* provided with two circumferential rows of small apertures (only two apertures of each row are shown by 168*a*, 168*c* and 170*a*, 170*c*) which are formed in the peripheral wall of the housing part and respectively in communication with fuel outlet ports formed in the housing part 134*a*. A rotor 148 is rotatably mounted in the housing part 134*a* and comprises a first part 148*a* rotatably supported by bearings 150 and 152 and drivingly connected to an associated engine (not shown) and a second cylindrical hollow part 148*b* rotatably and axially slidably received in a bore 136 in the housing part 134*a*. The two rotor parts 148*a* and 148*b* are keyed relative to each other at their inner ends so that the rotor part 148*b* is rotated by the first rotor part 148*a* and is axially movable relative to the first rotor part 148*a* when a plunger 162 connected to the outer end of the second rotor part 148*b* is moved by an air sensor (not shown). The second rotor part 148*b* defines therein an axial fuel passage 164. Trapezoid and triangular orifices 156 and 157 are formed in communication with the fuel passage 164 and in axial positions substantially aligned with the first and second rows of the small apertures 168*a* to 168*d* and 170*a* to 170*d* respectively. A radial fuel inlet 166 is also formed in the rotor part 148*b* so that fuel from a fuel pump (not shown) flows through a fuel inlet port 140 in the housing part 134*a* and through the fuel inlet 166 into the axial passage 164 in the rotor part 148*b*. The rotation of the rotor 148 relative to the housing part 134*a* causes the fuel to be distributed from the axial fuel passage 164 through the orifices 156 and 157 to the small apertures 168*a* to 168*d* and 170*a* to 170*d* and thus to the fuel outlet ports 144*a* to 144*d* and 145*a* to 145*d*, as in the first embodiment. The axial movement of the second rotor part 148*b* indicated by an arrow B in FIG. 5 is effective to vary the amounts of fuel to be distributed to the fuel outlet ports for the reasons discussed in connection with the first embodiment. Thus, the second embodiment is also operative to meter and distribute the fuel in accordance with the variation of the rate of engine intake air flow.

In the illustrated and described embodiments of the invention, the control shaft 60 and the second rotor part 148*b* are mechanically associated with the movable members of the air flow sensors so that the movements of the sensor members are mechanically transmitted to the control shaft and the rotor part. The movements of the sensor members, however, may alternatively be transformed into hydraulic pressure signals by which the control shaft 60 and the rotor part 148*b* are axially moved. The working medium may consist of the fuel in liquid state. Further alternatively, the rate of the engine intake air flow may be electrically detected by means of a conventional air flow sensor which emits an electric signal by which either a solenoid or a servo motor is actuated to axially move the control shaft 60 or the rotor part 148*b*. In the further alternative case, the operating parameter for the system of the invention may include not only the rate of engine intake air flow but also other engine operating parameter such as the temperature of engine cooling water.

The described and illustrated embodiments of the invention each use 2 series of fuel delivery circuits including fuel injectors. The number of the series of the fuel delivery circuits may be increased to 3 or 4. However, fuel delivery circuits of more than 5 series will complicate the structure of the system and thus will not be advisable.

What is claimed is:

1. A fuel injection system for an internal combustion engine, comprising:

a plurality of sets of fuel injectors adapted to be mounted on the engine;

each of the fuel injectors of each set being associated with one of the engine cylinders so that each engine cylinder is provided with a plurality of injectors equal in number to the fuel injector sets;

a fuel source operative to supply a fuel under a predetermined pressure to said fuel injectors;

means for metering the fuel from said fuel source and distributing the metered fuel to said fuel injectors;

said fuel metering and distributing means including a housing defining therein a fuel inlet port connected to said fuel source and a plurality of sets of fuel outlet ports each connected to one of said fuel injectors;

the fuel outlet port sets being equal in number to said fuel injector sets;

said fuel metering and distributing means further including a rotor and means defining a plurality of sets of apertures;

the apertures of each set being equal in number to the engine cylinders;

the aperture sets being equal in number to said fuel outlet sets and thus to said fuel injector sets;

said rotor being mounted in said housing for rotation in timed relationship to the engine operation and defining a plurality of orifices equal in number to said aperture sets and operatively associated respectively with said aperture sets;

one of said rotor and said aperture defining means being disposed inside the other and defining a fuel passage always in communication with said fuel inlet port in said housing;

each of said apertures being substantially aligned with one of said fuel outlet ports;

the rotation of said rotor moving said orifices relative to said apertures in the circumferential direction of said rotor so that at least one of said orifices is brought into overlapping and communicating relationship with successive apertures of the corresponding set to allow the fuel to flow from said fuel passages through the overlapped and communicated orifice and apertures to the associated fuel outlet ports and thus to the associated fuel injectors;

means responsive to variation in the rate of engine intake air flow to cause relative movement between said aperture defining means and said rotor so that relative movement between said rotor and said sets of apertures is caused axially of said rotor, the arrangement being such that the number of the orifices brought into overlapping and communicating relationship to the apertures is increased to increase the fuel supply to respective cylinders as the engine intake air flow rate is increased, and vice versa.

2. A fuel injection system as defined in claim 1, wherein said aperture defining means comprises a cylindrical hollow control shaft disposed in said housing in telescopic relationship to said rotor, said control shaft being axially movable relative to said rotor by said intake air flow rate respective means.

3. A fuel injection system as defined in claim 2, wherein said rotor extends into said control shaft.

4. A fuel injection system as defined in claim 1, wherein said apertures are formed in said housing in communication with said fuel outlet ports, respectively, and wherein said rotor comprises a first and second parts, said first rotor part being adapted to be driven by the engine, said second rotor part being coupled to said first rotor part such that said second rotor part is rotated by said first part and axially movable relative to said first rotor part by said intake air flow rate responsive means, said orifices being formed in said second rotor part.

5. A fuel injection system as defined in claim 1, 2, 3 or 4, wherein said rotor is provided with first and second orifices, the arrangement being such that, when the rate of the intake air flow is within a first range smaller than a predetermined rate, said first orifice only is moved by the rotation of said rotor into overlapping and communicating relationship to successive apertures of the associated set and such that, when said intake air flow rate is within a second range greater than said predetermined rate, said first and second orifices are both moved into overlapping and communicating relationship to successive apertures of the associated sets, respectively.

6. A fuel injection system as defined in claim 5, wherein the angle of rotation of said rotor over which said first orifice is overlapped and communicated with each of said apertures of the associated set during one revolution of said rotor is varied with the increase and decrease in the intake air flow rate within said first range and is substantially constant regardless of the variation in the intake air flow rate within said second range.

7. A fuel injection system as defined in claim 6, wherein the angle of rotation of said rotor over which said second orifice is overlapped and communicated with each of said apertures of the associated set during one revolution of said rotor is varied with the increase and decrease in the intake air flow rate within said second range.

* * * * *